US007958908B2

(12) United States Patent
Cho et al.

(10) Patent No.: US 7,958,908 B2
(45) Date of Patent: Jun. 14, 2011

(54) FLOW CONTROL VALVE

(75) Inventors: Ryosuke Cho, Tokyo (JP); Toshiaki Iwa, Tokyo (JP); Norio Uemura, Tokyo (JP)

(73) Assignee: Eagle Industry Co., Ltd., Tokyo (JP)

( * ) Notice: Subject to any disclaimer, the term of this patent is extended or adjusted under 35 U.S.C. 154(b) by 708 days.

(21) Appl. No.: 11/887,922

(22) PCT Filed: Apr. 5, 2006

(86) PCT No.: PCT/JP2006/307203

§ 371 (c)(1),
(2), (4) Date: Oct. 5, 2007

(87) PCT Pub. No.: WO2006/109641

PCT Pub. Date: Oct. 19, 2006

(65) Prior Publication Data

US 2009/0057586 A1 Mar. 5, 2009

(30) Foreign Application Priority Data

Apr. 8, 2005 (JP) ..... 2005-112587

(51) Int. Cl.
*F15B 13/044* (2006.01)
*F04B 1/26* (2006.01)

(52) U.S. Cl. ..... 137/625.26; 417/222.2

(58) Field of Classification Search ..... 137/625.26, 137/625.27; 417/222.2
See application file for complete search history.

(56) References Cited

U.S. PATENT DOCUMENTS 955,770 A * 4/1910 Dehn ..... 137/625.26
2,564,686 A * 8/1951 Gray ..... 137/625.26
2,934,090 A * 4/1960 Kenann et al. ..... 137/625.27
3,164,173 A * 1/1965 Semon ..... 137/625.26
3,168,353 A * 2/1965 Horowitz ..... 137/625.26
3,174,511 A * 3/1965 Parker ..... 137/625.65
3,273,579 A * 9/1966 Koculyn ..... 137/625.26
4,074,700 A * 2/1978 Engle ..... 137/625.27
4,611,631 A * 9/1986 Kosugi et al. ..... 137/625.27
4,823,842 A * 4/1989 Toliusis ..... 137/625.65

(Continued)

FOREIGN PATENT DOCUMENTS

DE 198 55 667 A1 12/1998
DE 10 2004 035 855 A1 7/2004
EP 1 099 852 A2 11/2000
EP 1 363 023 A2 11/2003
JP 11-198797 A 7/1999
JP 2001-132632 A 5/2001
JP 2001-342946 A 12/2001
JP 2003-278650 A 10/2003
JP 2003-328936 A 11/2003
JP 2004-156575 A 6/2004
JP 2005-055167 A 3/2005

*Primary Examiner* — John Rivell
(74) *Attorney, Agent, or Firm* — Arent Fox LLP

(57) ABSTRACT

A capacity control valve, comprising a first valve chamber formed in a valve body, a first fluid passage communicating with the first valve chamber to flow a fluid with a discharge pressure therein, a valve seat formed around a valve port between the first valve chamber and the first fluid passage, a second fluid passage communicating with the first valve chamber to flow the fluid with the discharge pressure therefrom, a second valve chamber communicating with the first valve chamber through a guide hole, a third fluid passage communicating with the second valve chamber to flow the fluid with a suction pressure therein and therefrom, a valve element disposed in the first valve chamber and having a valve part separated from and brought into contact with the valve seat to flow the fluid with the discharge pressure therein and a stem part movably fitted to the guide hole, and a solenoid having a solenoid rod connected to the connection face of the valve element and moving the solenoid rod with a current, A discharge pressure receiving area in a connection surface between the valve part and the valve seat is set larger than the pressure receiving area of the stem part.

3 Claims, 4 Drawing Sheets

U.S. PATENT DOCUMENTS

| | | | | |
|---|---|---|---|---|
| 5,947,155 | A * | 9/1999 | Miki et al. | 137/625.65 |
| 6,209,970 | B1 | 4/2001 | Kamiya et al. | |
| 6,354,811 | B1 | 3/2002 | Ota et al. | |
| 6,585,494 | B1 * | 7/2003 | Suzuki | 417/222.2 |
| 6,837,451 | B2 * | 1/2005 | Rodriguez-Amaya et al. | 137/625.26 |
| 7,037,087 | B2 * | 5/2006 | Uemura et al. | 417/222.2 |
| 7,273,356 | B2 * | 9/2007 | Ochiai | 417/222.2 |
| 2002/0141881 | A1 * | 10/2002 | Okada et al. | 417/222.2 |
| 2003/0024257 | A1 * | 2/2003 | Hirota et al. | 417/222.2 |
| 2003/0035733 | A1 * | 2/2003 | Hirota | 417/222.2 |
| 2003/0202885 | A1 * | 10/2003 | Taguchi | 417/222.2 |
| 2003/0210988 | A1 | 11/2003 | Hirota et al. | |
| 2005/0053474 | A1 * | 3/2005 | Hirota et al. | 417/222.2 |

* cited by examiner

FLOW CONTROL VALVE

CROSS-REFERENCE TO RELATED APPLICATION

This application is a National Stage entry of International Application Number PCT/JP2006/307203, filed Apr. 5, 2006. The disclosure of the prior application is hereby incorporated herein in its entirety by reference.

TECHNICAL FIELD

The present invention relates to a flow control valve and, more particularly, a flow control valve for preventing hunting of the valve body from being induced by the pressure of operating fluid which flows through a valve orifice during a valve opening action.

BACKGROUND ART

There is a flow control valve used for a variable displacement compressor as prior art of the present invention. This flow control valve controls the operating fluid during valve opening action by accurately positioning the valve body relative to the valve seat in accordance with electric current supplied to a solenoid. Pressure of the operating fluid, however, raises a hunting problem of the valve body. This will lead to an insufficient control of the operating fluid and unexpected operation of the variable displacement compressor and the like. FIG. 4 shows a full cross-sectional view of a flow control valve related to the art (for example, refer to patent reference 1 listed below). This flow control valve, for instance, modulates pressure and flow of the operating fluid used in air conditioner and the like. In the refrigerant cycle of the air conditioner and the like in which CO.sub.2 is used as operating fluid, generally the service pressure range becomes more than ten times compared with those of conventional refrigerants. Therefore a variety of problems may be induced by the operating fluid. Not only CO.sub.2 as operating fluid but also high-pressure operating fluid impose more difficulties on control of the operating fluid compared with conventional low-pressure operating fluid.

100 in FIG. 4 designates a flow control valve. The flow control valve 100 is comprised of a valve main body 101 and a solenoid portion 120. The solenoid portion 120 is integrally joined with the valve main body 101. Supplying electric current to the solenoid portion 120 actuates a solenoid rod 122 being guided by a bearing 123 in accordance with the intensity of the current. Next, the valve main body 101 forms an axially extending through hole therein. A shaft 112 is disposed in the through hole in freely movable manner. Also a sliding portion of a valve body 102 connected to the shaft 112 forms a freely slidable fit engagement to the hole. Dimension of the sliding portion is given by B. Figure upper portion of this valve body 102 defines a high-pressure valve body 102A while the solenoid portion 120 side defines a low-pressure valve body 102B. Respective dimension in diameter of the high-pressure valve body 102A and the low-pressure valve body 102B is given by D. Conical surfaces formed at the end tips of the high-pressure valve body 102A and the low-pressure valve body 102B are, respectively, defined as a first valve face 102C and a second valve face 102D.

The valve main body 101 disposes a suction port 106 which introduces fluid of suction pressure Ps, and the suction port 106 is able to communicate a control chamber (pressure regulation camber), not shown, via suction relief valve and orifice which are disposed in a communication passage, not shown.

As shown in the upper portion of the figure, a second control port 105 is disposed which is able to communicate the control chamber and a second valve chamber. The second control port 105 admits fluid of control pressure Pc2. Even further up in the figure, there is disposed a first control port 104 which is able to communicate a first valve chamber 107 and the control chamber. The second control port 104 admits fluid of control pressure Pc1. The second valve chamber and suction passageway 106 communicate each other via a bypassing passageway. In the valve main body 101, a first valve seat is formed on the periphery of the first valve orifice which is located at the interface which communicates a discharge port 103 with the first valve chamber 107 in which the first valve face 102C lifting from or resting on the first valve seat makes opening/closing of the discharge port 103. And the fluid under discharge pressure Pd is allowed to flow into the first valve chamber 107 side from the discharge port 103. Also a second valve seat is formed on the periphery of the second valve orifice of a communication passage port in which the second valve face 102D lifting from or resting on the second valve seat makes opening/closing the passage between the second valve chamber and the suction port 106. The dimension A of the diameter of the discharge port 103 is identical to the dimension C of the diameter of the communication passage port.

In the flow control valve thus configured, the diameters of the first valve orifice and the second valve orifice, which lifts from or rest on the first valve face 102C and the second valve face 102D, respectively, share the same dimension. Therefore the forces exerted to the valve body 102 by the control fluid Pc1 and the control fluid Pc2 negate each other. This implies that the valve body 102 is actuated by means of suction pressure Ps and discharge pressure Pd alone. When the pressure differential between discharge pressure Pd and suction pressure Ps becomes greater than an attraction force determined by the current supplied to the solenoid portion 120, high-pressure valve body 102A opens so as to achieve flow control. In such an operation of the valve body 102, since the diametral dimension D of the high-pressure valve body 102A is greater than the diametral dimension A of the discharge port 103, a decrease in pressure differential between discharge pressure Pd and suction pressure Ps will reduce a pressure-driven retaining force of the valve body, thereby inducing a hunting phenomenon in which the valve body 102 makes pulsating movement in the axial direction because the valve body 102 is easily susceptible to a force due to pulsation or turbulent flow of the fluid under discharge pressure Pd. Occurrence of such hunting phenomenon in the valve body 102 makes it difficult to conduct a flow control. Also as the magnitude (intensity) of the current supplied to the solenoid portion 120 no longer remains proportionate to the operation speed in opening/closing of the valve body 102, a flow control for the fluid under discharge pressure Pd by means of the valve body 102 is likely to deteriorate.

Patent reference 1: Japanese Patent Laid-Open Publication No. 2003-328936 (FIG. 2 and FIG. 3)

DISCLOSURE OF THE INVENTION

Technical Problems to be Solved by the Invention

The present invention is proposed for alleviating the above mentioned disadvantages, and the technical problem to be solved by the invention is to prevent occurrence of a hunting in the valve body when the valve body makes a valve opening action due to discharge pressure. Another technical problem is to achieve a precise flow control under discharge pressure.

Means for Solving the Technical Problems

A primary object of the present invention is to solve the above mentioned technical problems, and a solution to such problems is embodied as follows.

Flow control valve of the present invention is a flow control valve for controlling a flow pressure or flow volume of control chamber by regulating fluid flow under discharge pressure. The flow control valve is comprised of a first valve chamber being disposed in a valve main body, a first fluid passage communicating with the first valve chamber and introducing the fluid under the discharge pressure, a valve seat being disposed in the periphery of the valve orifice at the interface between the first valve chamber and the first fluid passage, a second fluid passage communicating with the first valve chamber and discharging the fluid under the discharge pressure, a second valve chamber communicating with the first valve chamber via a guide bore, a third fluid passage communicating with the second valve chamber and introducing or discharging fluid under suction pressure, a valve body being disposed in the first valve chamber and having a valve portion and a shaft portion, in which the valve portion introduces the fluid under the discharge pressure by lifting from or resting on the valve seat, in which the shaft portion fits the guide bore in freely moveable manner, and a solenoid disposing a solenoid rod and making the solenoid rod move in accordance with the current supplied in which the solenoid rod forms a joint with the valve body, wherein a pressure-receiving area of the discharge pressure in the contact interface between the valve portion and the valve seat is arranged larger than a pressure-receiving area of the shaft portion.

Effects of the Invention

The flow control valve of the present invention is comprised of a first fluid passage which communicates with the first valve chamber and introduces the fluid under the discharge pressure, a valve seat which is disposed in the periphery of the valve orifice at the interface between the first valve chamber and the first fluid passage, a second fluid passage which communicates with the first valve chamber and discharges the fluid under the discharge pressure, and a valve body which is disposed in the first valve chamber and has a valve portion and a shaft portion therein, in which the valve portion introduces the fluid under the discharge pressure by lifting from or resting on the valve seat, in which the shaft portion fits the guide bore in freely moveable manner, wherein a pressure-receiving area of the discharge pressure in the contact interface between the valve portion and the valve seat is arranged larger than a pressure-receiving area of the shaft portion. Therefore, a force acted on the valve body is given by $F=Pd\times B-Ps\times A+Pc\ (B-A)$, which always operates on the valve body for opening the valve, thereby preventing occurrence of hunting phenomenon in the valve body. Also being able to increase the pressure-receiving area of discharge pressure is advantageous in that the flow capacity of the first fluid passage can be increased and even a compact flow control valve exhibits an outstanding control capability of the control chamber.

DESCRIPTION OF REFERENCE NUMERALS

Figure 1:
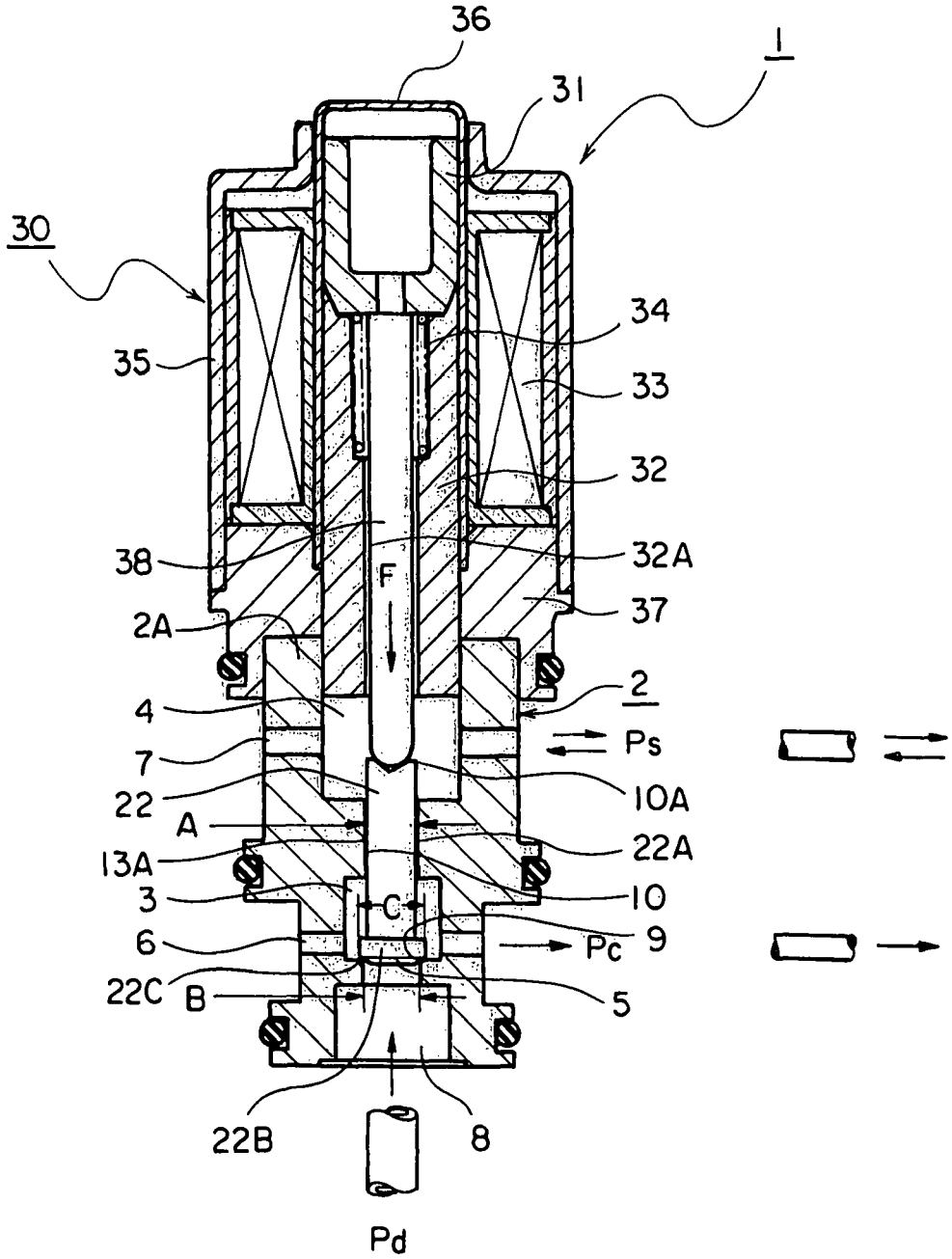
FIG. 1 is a full cross-sectional view of a flow control valve as a first embodiment.

1 flow control valve
2 valve
2A valve housing (valve main body)
3 first valve chamber
4 second valve chamber
5 first fluid passage
6 second fluid passage
7 third fluid passage
8 flow-in cavity
9 valve seat
10 guide bore
10A joint surface
22 valve body
22A outer circumferential surface
22B valve portion
22C valve face
30 solenoid
31 moveable attraction element
32 fixed attraction element
32A inner circumferential surface
33 coil portion
36 sleeve
37 connecting portion
38 solenoid rod

BEST MODE FOR CARRYING OUT THE INVENTION

Described below is the details of the figures of a preferred embodiment in accordance with the principles of the present invention. All the figures explained below are constructed according to actual design drawings with accurate dimensional relations.

Figure 3:
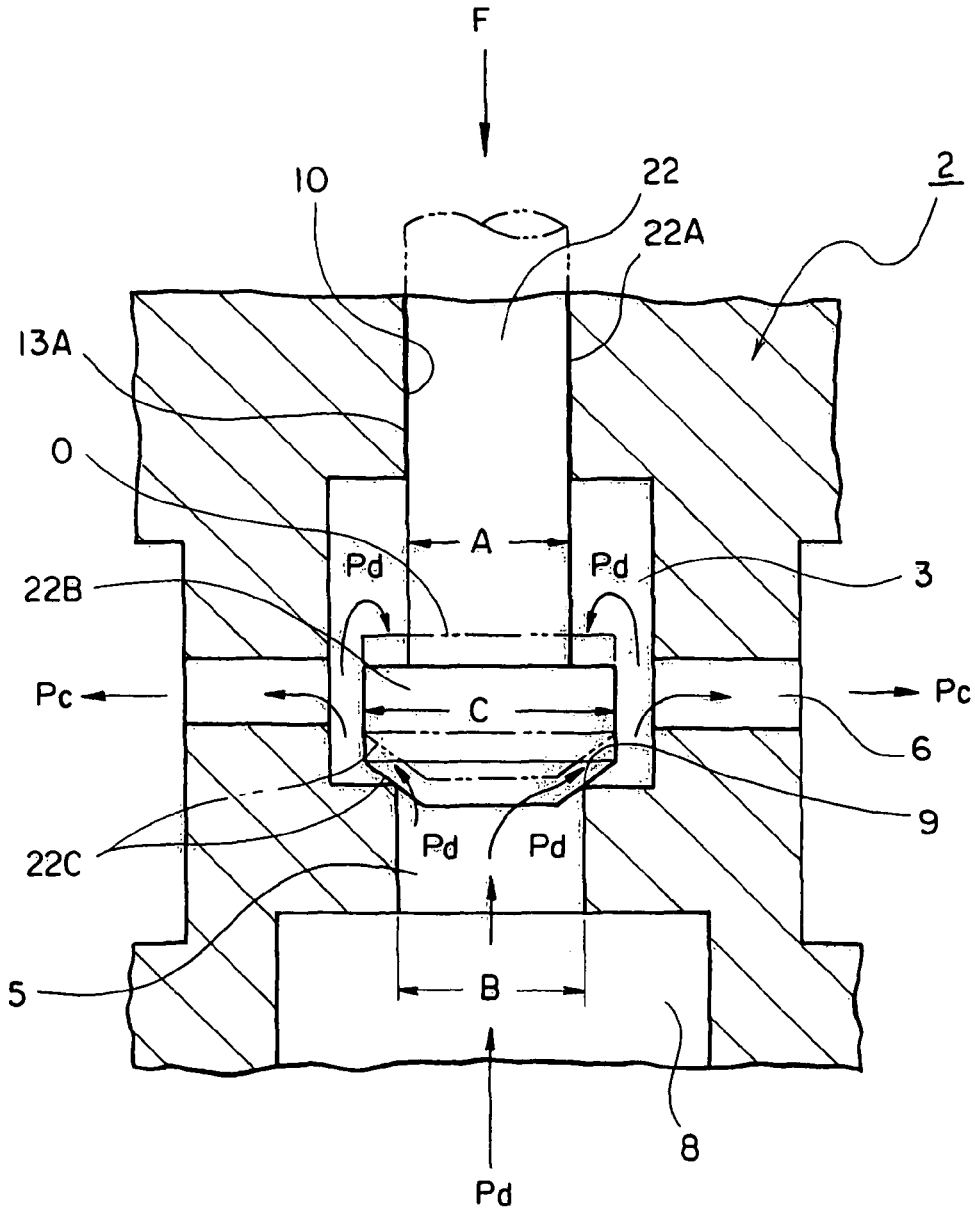
FIG. 3 is an enlarged cross-sectional view of a vicinity of the valve portion in the flow control valve shown in FIG. 1.
Figure 4:
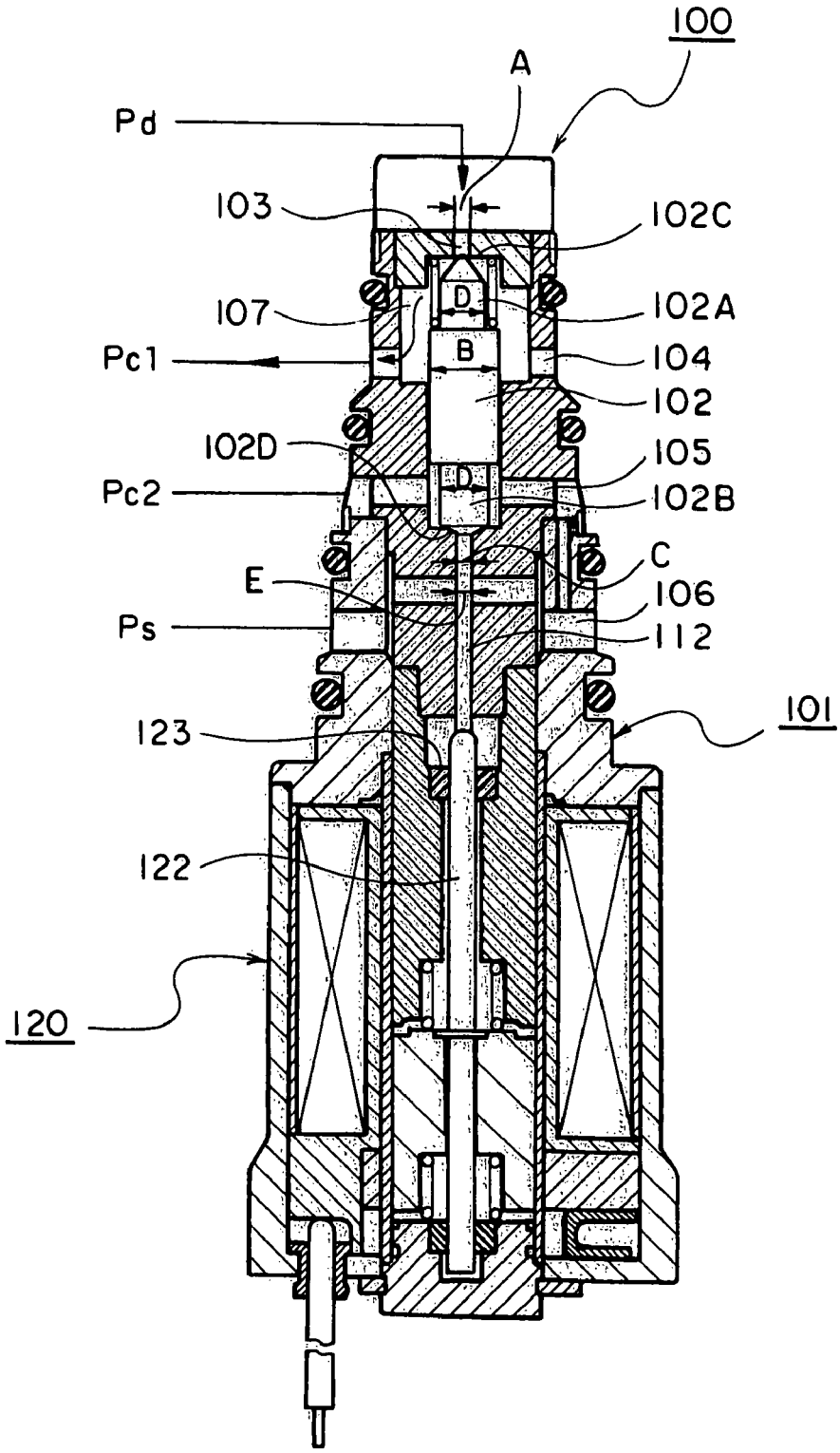
FIG. 4 is a full cross-sectional view of a flow control valve as a prior art similar to the present invention.

FIG. 1 is a full cross-sectional view of a flow control valve as a first embodiment related to the present invention. Also FIG. 3 is a portional, enlarged cross-section view illustrating the vicinity of the valve portion in FIG. 1. In FIG. 1 (also referring to FIG. 3), 1 designates a flow control valve. The flow control valve 1 is comprised of a valve 2 and a solenoid 30. The valve 2 disposes a valve housing (also referred to as a valve main body) 2A which defines outer form thereof. This valve housing 2A disposes a first valve chamber 3 in axial center thereof. There is also disposed a first fluid passage 5 which admits fluid under discharge pressure Pd from outside into the first valve chamber 3. Defined by B is a pressure-receiving area (pressure-receiving area of the seal face defined by the contact between the valve face and the valve seat). Flow-in cavity 8 formed in the upstream (outboard) of the first fluid passage 5 is equipped with a filter for eliminating dusts and the like. There is also disposed a valve seat 9 at the interface between the valve chamber 3 and the first fluid passage 5.

Further disposed in the first valve chamber 3 is a second fluid passage 6 which admits the fluid under discharge pressure Pd into a control chamber, not shown. Fluid flowing into the control chamber via the second fluid passage 6 is under control pressure Pc. This second fluid passage 6 should preferably be disposed in plurality which radially span from the center of the first valve chamber 3. There is also disposed a second valve chamber 4 communicating with the first valve chamber 3 via guide bore 10 which extends through the axis of the first valve chamber 3. The second valve chamber 4 disposes third fluid passage 7 for allowing flow-in and flow-out of the fluid under suction pressure Ps. This third fluid passage 7 should preferably be disposed in plurality which radially span from the center of the second valve chamber 4. The guide bore 10 in the valve housing 2A might as well have a slightly larger diametrical dimension than that of the outer diameter surface 22A of the shaft portion so that fluid is allowed to pass through a passageway 13A which is formed between the guide bore 10 and the outer diameter surface 22A. This permits fluid located at one end for flowing through the passageway 13A to the other end due to the pressure differential between suction pressure Ps and control pressure Pc. The passageway 13A forming a small annulus on the periphery of the shaft portion can make the shaft portion aligned in the axial center as the result of the uniform flow formed between the outer diameter surface 22A of the shaft portion and the guide bore 10.

Valve body 22 disposed in the first valve chamber 3 and the second valve chamber 4 has a shaft portion with a cross section area "A" which served as a pressure-receiving area, and disposes a valve portion 22B of diameter "C" in the end portion of the shaft portion. The end tip of this valve portion 22B forms a valve face 22C of a truncated cone shape which lifts from or rests on a first valve seat 9. The other end of the valve body 22 opposite the valve portion 22B forms a recessed conical shape, defining a joint surface 10A. Pressure-receiving area of the joint surface 10A is "A" as well. The passageway 13A formed in the clearance between the shaft portion of this valve body 22 and the guide bore 10 allows the fluid in the first valve chamber 3 under discharge pressure Pd to flow into the second valve chamber 4. Also the shaft portion of the valve body 22 makes a movement under a guidance of the guide bore 1010 and the valve portion 22B opens or closes the valve by lifting from or resting on the first valve seat 9. This valve opening/closing action enables the fluid under discharge pressure Pd to flow from the first fluid passage 5 to the first valve chamber 3.

The solenoid 30 disposes a connecting portion 37 which has a bore-like recessed portion for making a secure engagement with the end portion of the valve housing 2A. The connecting portion 37 is fixed with a casing 35 which contains a coil element 33 therewithin. In the inner circumferential portion of the coil element 33, one end portion of a sleeve 36 is securely fitted between the fixed attraction element 32 and the connecting portion 37 while the other end portion is joined with the inner circumferential surface of the casing 35. In addition, there is disposed a moveable attraction element 31 which fits the inner circumferential surface of the sleeve 36 in freely moveable manner. This moveable attraction element 31 is connected with one end of a solenoid rod 38. The other end surface of the solenoid rod 38 forms a contact with the joint surface 10A of the valve body 22. Also the fixed attraction element 32 arranged in opposing manner against the moveable attraction element 31 is securely fixed inside the sleeve 36 and the connecting portion 37.

And the fixed attraction element 32 gives an attraction force to the moveable attraction element 31 in accordance with the intensity of the current supplied to the coil element 33. The inner circumferential surface 32A of the fixed attraction element 32 forms a clearance fit with the solenoid rod 38. The fluid under suction pressure Ps is introduced to the clearance gap between the inner circumferential surface 32A of the fixed attraction element 32 and the solenoid rod 38 so as to avoid occurrence of pressure imbalance due to suction pressure Ps within the solenoid element. The upper portion shown in the figure of the inner circumferential surface 32A of the fixed attraction element 32 is arranged in a large diameter for receiving a spring 34. The spring 34 always exerts a resilient, urging force so as to keep the moveable attraction element 31 sway from the fixed attraction element 32. Urging force of the solenoid rod 38 is determined as a mutually opposing force resulted from the joint attraction force of the moveable attraction element 31 and the fixed attraction element 32 and the spring force given by the spring 38.

The flow control valve 1 thus configured creates a contact state between the joint surface 10A of the valve body 22 and the end portion of the solenoid rod 38. And the moveable attraction element 31 is attracted toward the fixed attraction element 32 in accordance with the intensity of the current supplied to the coil element 33. The moveable attraction element 31, on the other hand, is resiliently urged by the spring 34 in the opposite direction of the attraction force. This valve body 22 lifts from or rests on the valve seat 9 according to a set force determined by an attraction force given to the moveable attraction element 31 in accordance with the intensity of the current supplied to the coil element 33 and an opposing spring force, thereby opening or closing the valve orifice. If, for instance, the current supplied to the coil element 33 is reduced, then the valve body 22 lifts from the valve seat 9, thereby opening the valve orifice. The fluid under discharge pressure Pd then flows in from the first fluid passage 5, runs through the first valve chamber 3 and flows out to the second fluid passage 6 to become fluid under control pressure Pc. In this case, as the pressure-receiving area "A" of the shaft portion is arranged smaller than the pressure-receiving area "B" at the valve orifice of the first valve chamber 3, the valve body 22 operates based on the force relation (numeral 1) given below as clearly seen from FIG. 1 or FIG. 3.

(numeral 1)

$$F=Pd\times B-Ps\times A+Pc\ (B-A)$$

where F is a force for closing the valve body,

Pd is discharge pressure,

Pc is control pressure,

Ps is suction pressure,

A is pressure-receiving area of the shaft portion,

B is pressure-receiving area of the valve orifice, in which the discharge pressure Pd is greater than control pressure Pc and suction pressure Ps when the valve body 22 is in a valve opening action.

And the force "F" given by the solenoid 30 and the forces acted via valve orifices oppose with respect to the valve body 22. Therefore, in case of valve opening action of the valve body 22, occurrence of hunting of the valve body 22 due to the operating fluid can be prevented. In the conventional setting in which the pressure-receiving area "A" of the shaft portion and the pressure-receiving area "B" of the valve orifice have an identical area size, a relation $F2=A(Pd-Ps)$ follows and a pressure change in discharge pressure Pd and suction pressure Ps is likely to cause hunting of the valve body 22. The pressure-receiving area "B" of the valve orifice should preferably be larger than the pressure-receiving area "A" of the shaft portion by the range of from 1% to 20%. The pressure-receiving area "B" of the valve orifice should be determined by considering strength of spring force of the spring 34 as well as magnitude of discharge pressure Pd relative to the pressure-receiving area "A" of the shaft portion.

Figure 2:
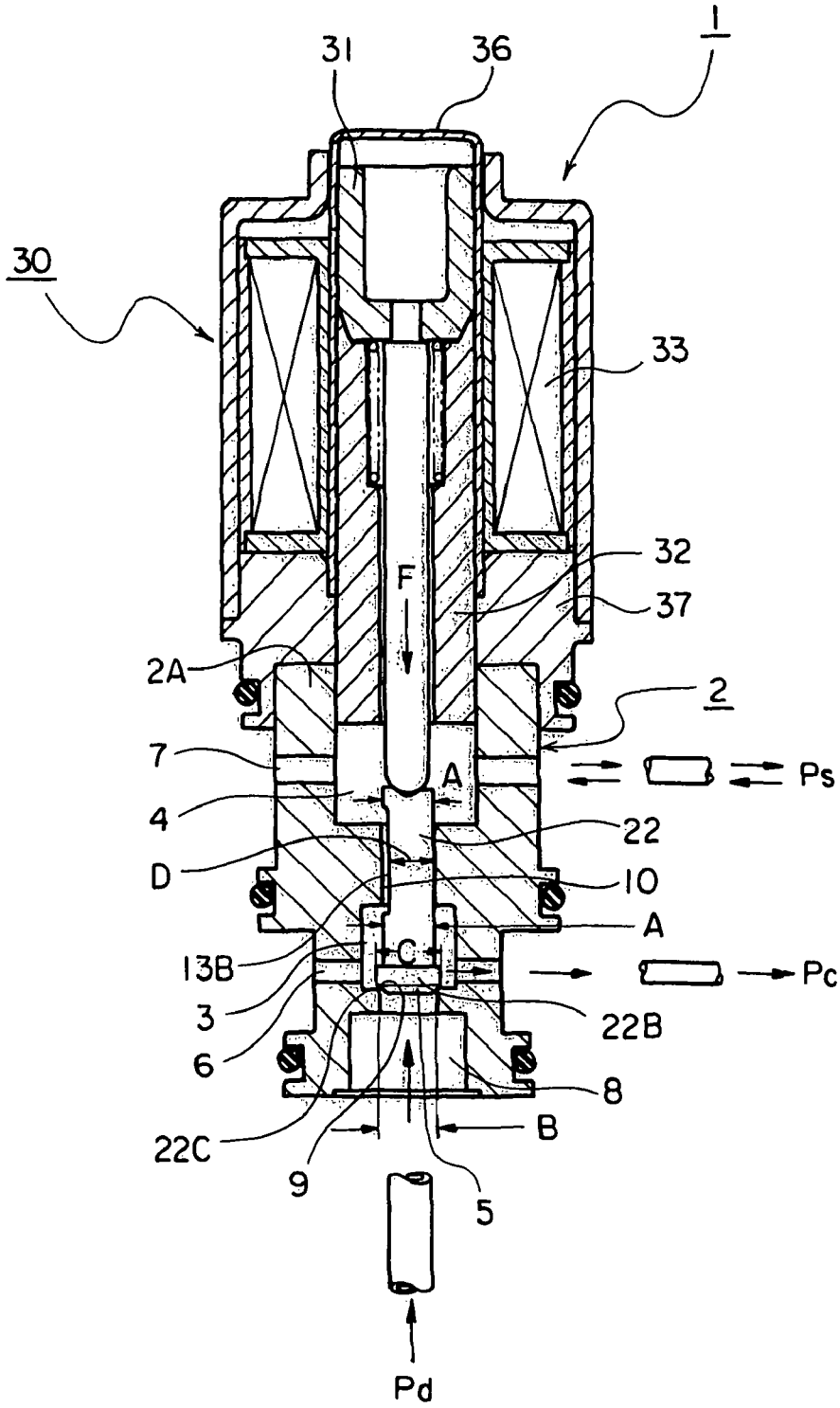
FIG. 2 is a full cross-sectional view of a flow control valve as a second embodiment related to the present invention.

FIG. 2 is a full cross-sectional view of a flow control valve as a second embodiment related to the present invention. What makes a flow control valve 1 of FIG. 2 different from that of FIG. 1 is that a plane surface 13B is disposed on the outer circumferential surface 22A of the shaft portion in the valve body 22 by chamfering a portion of the diameter surface. Dimensional differential from the outer circumferential surface 22A to the plane surface 13B is given by "A-D". Disposition of the plane surface 13B forms a passageway 13A between the plane surface 13B and the guide bore 10. The small dimensional differential between the diameter of the shaft portion and the diameter of the guide bore 10 provides a support to maintain axial center of the shaft portion. This passageway 13A establishes a secure communication between the second fluid passage 6 and the third fluid passage 7 for a sufficient flow passage therebetween. Disposition of this passageway 13A urges the shaft portion 22 to be guided in axial direction thereof by means of the guide bore 10, thereby preventing lateral movement thereof in radial direction thereof. As a result, the valve face 22C of the valve body 22 in conjunction with the valve seat is able to securely close the valve.

Application of this flow control valve 1 to a conventional variable displacement compressor will be described next. The variable displacement compressor is so well-known that figure thereof is omitted. Flow-in cavity 8 side of the first fluid passage 5 communicates with a discharge chamber of the variable displacement compressor, not shown. Then the discharge chamber communicates with inside cylinders via discharge lead valve. Also the second fluid passage 6 communicates via communication passage to a control chamber (pressure regulation chamber). Furthermore the third fluid passage 7 communicates with a suction chamber. Within the suction chamber, a swash plate is installed in the rotary shaft in tiltable manner. This swash plate then is connected with individual pistons which are fitted to respective cylinders in freely reciprocating manner. And the angle of the swash plate is varied by regulating the pressure inside the pressure regulation chamber according to discharge chamber Pd, suction chamber Ps and control (pressure regulation chamber) pressure Pc adjusted by means of flow control valve 1, thereby creating reciprocal movement of the pistons. The reciprocal movement of the piston varies a volume within the cylinder. This volumetric change enables the variable displacement compressor to operate under a maximum volume or under a minimum volume. Under this variable displacement operation, hunting induced in the valve body 22 deteriorates precision in flow control. The present invention, however, prevents occurrence of hunting and realizes an accurate operation of the variable displacement compressor.

Construction and operational effect of a mechanical seal device as other embodiment related to the present invention will be described below.

In a flow control valve of the first invention relative to the present invention, a fluid passage is disposed between a shaft portion of the valve body and a guide bore, thereby communicating the first valve chamber with the second valve chamber.

According to the flow control valve of the first invention, the passageway 13A permits fluid to communicate between the first valve chamber 3 (first fluid passage 5) and the second valve chamber 4 (third fluid passage 7). Therefore, a force imbalance acted on the valve body 22 due to control pressure Pc is cancelled so that only a pressure differential between discharge pressure Pd via first fluid passage 5 and suction pressure Ps via third fluid passage 7 can be acted on the valve body 22. Also as the suction pressure Ps is located in the operational portion side with respect to the solenoid 30 and can be delivered to inside the solenoid 30 through the clearance gap between the solenoid rod 38 and the inner circumferential surface 32A of the fixed attraction element 32, unwanted operational force due to suction pressure Ps can be prevented during the action of the solenoid rod 38.

In a flow control valve of the second invention relative to the present invention, a guide bore fittingly guides a shaft portion in freely slidable manner and a passageway is arranged to have a clearance which is formed by chamfering the outer circumferential surface of the shaft portion.

According to the flow control valve of the second invention in which the passageway 13A is formed by chamfering the outer circumferential surface 22A of the shaft portion in the valve body 22, since the shaft portion and the guide bore 10 make a sliding movement under a contact state except on the chamfered portion, fluctuation of the shaft axis can be eliminated by the guide bore 10 guiding the shaft portion. This not only makes it possible to cancel an force imbalance acted on the valve body during the operation of the valve body 22, but also makes the valve portion 22B and the valve seat 9 to achieve precise lifting/resting operations for opening/closing operations of the valve. Therefore flow control as well as pressure control of the flow control valve 1 will be enhanced.

INDUSTRIAL APPLICABILITY

As described so far a flow control valve of the present invention is advantageous in the applications to pneumatic machinery, compressor and the like. It is particularly advantageous as a flow control valve for preventing hunting of the valve body and assuring precise flow control.

The invention claimed is:

1. A flow control valve for controlling a flow pressure or flow volume of control chamber by regulating fluid flow under discharge pressure, said flow control valve comprising:

a) a first valve chamber being disposed in a valve main body;

b) a first fluid passage communicating with said first valve chamber and introducing the fluid under said discharge pressure;

c) a valve seat being disposed in the periphery of the valve orifice at the interface between said first valve chamber and said first fluid passage;

d) a second fluid passage communicating with said first valve chamber and discharging the fluid under said discharge pressure;

e) a second valve chamber communicating with said first valve chamber via a guide bore;

f) a third fluid passage communicating with said second valve chamber and introducing or discharging fluid under suction pressure;

g) a valve body having a valve portion and a shaft portion, said valve portion being formed at one end portion of said valve body, being disposed in said first valve chamber, and introducing the fluid under said discharge pressure by lifting from or resting on said valve seat, said shaft portion fitting said guide bore in freely moveable manner, and the other end portion of said valve body opposite said valve portion being disposed in said second valve chamber, being formed in a condition that said fluid under suction pressure introduced or discharged through said third fluid passage acts on said valve body toward said valve portion with a cross section area of said shaft portion fitted into said guide bore as a pressure-receiving area; and h) solenoid disposing a solenoid rod and making said solenoid rod move in accordance with the current supplied, said solenoid rod forming a joint with said valve body, wherein a pressure-receiving area of said discharge pressure in the contact interface between said valve portion and said valve seat is arranged larger than a pressure-receiving area of said shaft portion.

2. A flow control valve as claimed in claim 1 wherein a passage for fluid is disposed between said shaft portion of said valve body and said guide bore in which said fluid passage communicates with said first valve chamber and said second valve chamber.

3. A flow control valve as claimed in claim 2 wherein the outer circumferential surface of said shaft portion is fitted with said guide bore in freely slidable manner and said passage forms a clearance gap by chamfering the outer circumferential surface of said shaft portion.

* * * * *